US008747732B2

(12) United States Patent
Kudryavtsev et al.

(10) Patent No.: US 8,747,732 B2
(45) Date of Patent: Jun. 10, 2014

(54) ULTRASONIC INSTRUMENT FOR THE DEFORMATION TREATMENT OF SURFACES AND WELD JOINTS

(75) Inventors: Yuriy Kudryavtsev, Thornhill (CA); Jacob Kleiman, Thornhill (CA); Oleksandr Lugovskyi, Kiev (UA); Andrey Movchanyuk, Korosten (UA)

(73) Assignee: Structural Integrity Technologies, Inc., Markham, Ontario (CA)

( * ) Notice: Subject to any disclaimer, the term of this patent is extended or adjusted under 35 U.S.C. 154(b) by 0 days.

(21) Appl. No.: 13/634,302

(22) PCT Filed: Sep. 3, 2010

(86) PCT No.: PCT/UA2010/000057
§ 371 (c)(1),
(2), (4) Date: Nov. 9, 2012

(87) PCT Pub. No.: WO2011/112163
PCT Pub. Date: Sep. 15, 2011

(65) Prior Publication Data

US 2013/0049270 A1 Feb. 28, 2013

(30) Foreign Application Priority Data

Mar. 12, 2010 (UA) ..... 201002798

(51) Int. Cl.
*C21D 1/34* (2006.01)

(52) U.S. Cl.
USPC ..... 266/99; 266/48

(58) Field of Classification Search
USPC ..... 266/99, 48
See application file for complete search history.

(56) References Cited

U.S. PATENT DOCUMENTS

2013/0049270 A1 * 2/2013 Kudryavtsev et al. ..... 266/99

FOREIGN PATENT DOCUMENTS

| | | | |
|---|---|---|---|
| RU | 2141892 | C1 | 11/1999 |
| RU | 2259912 | C1 | 9/2005 |
| SU | 821786 | A | 4/1981 |
| UA | 87006 | C2 | 6/2009 |
| WO | WO 2005/042206 | A1 | 5/2005 |

* cited by examiner

*Primary Examiner* — Scott Kastler
(74) *Attorney, Agent, or Firm* — Fay Sharpe LLP

(57) ABSTRACT

An ultrasound device for the treatment of surfaces and welded joints is disclosed. The device has a housing with a plurality of shaped slots formed therein. A reciprocally moveable sleeve is attached to the housing, and contains an ultrasonic transducer. A reciprocally moveable attachment is attached to an operating end of the sleeve, and has a detachable working head mounted thereon. A pin is positioned in a pin slot on the housing, and anchors the sleeve to the housing to limit movement of the sleeve. The pin is biased towards the front of the pin slot by means of a spring, and a moveable spigot provides a predetermined contact force between the ultrasound device and a work surface. The spigot has spigot pins that are inserted into the plurality of shaped slots in the housing in order to restrict axial movement of the spigot, thereby providing added compression or tension to the spring in order to provide the predetermined contact force.

18 Claims, 1 Drawing Sheet

ULTRASONIC INSTRUMENT FOR THE DEFORMATION TREATMENT OF SURFACES AND WELD JOINTS

FIELD OF THE INVENTION

This invention applies to the field of technological use of the energy of ultrasound oscillations and may be used in machine building, shipbuilding, and other industries, particularly for improved treatment of parts and welded joints and structures operating under vibration and cyclic loading. Surface improvement of metal parts and welded joints, as the final technological process, considerably increases the endurance of the machine parts and enhances their quality and fatigue life. Presently, the most widespread methods of surface treatment using plastic deformation are treatments by shot peening, rolling, hammer peening, vibration roller burnishing, and other such methods. The high-energy processes of surface treatment have generated substantial interest, with surface improvement with the help of ultrasound oscillations being one of them. As test results and operational practices reveal, the ultrasonic method has proven to be sufficiently effective in the treatment of metals, especially high-strength materials. It has facilitated a considerable increase in the mechanical properties of structural materials, especially of their fatigue life and durability. In turn, the efficiency and quality of the ultrasonic treatment process and its serviceability rely considerably upon the design of the ultrasonic device.

BACKGROUND OF THE INVENTION

It is known in the art to use a vibro-impact device with ultrasound excitation (as seen in Russian patent no. 2179919) comprising a housing with a handle; a source of oscillation excitation consisting of a magnetostrictive transducer and the vibrational velocity transformer, placed with a clearance in the housing on sliding guides, with the ability of reciprocating motion and making contact to the housing through a spring; a working head with strikers aligned with the vibrational velocity transformer; and an air cooling system for the magnetostrictive transducer.

The air cooling system in such a vibro-impact device diverts the heat from the magnetostrictive transducer only. The working head with strikers, which heats up considerably during its operation, is not cooled in the instrument, which greatly reduces the time the vibro-impact device can stay in operation. Another drawback of such a device is inconsistent quality of treatment of surfaces and welded joints, which results from changes in the hold-down force exerted by the operator when pressing the strikers to the treated surface through the handle, housing, spring, and the vibrational excitation source. This occurs because the direction of the gravitational force exerted by the vibration excitation source upon the spring will vary depending on the device's spatial positioning. When the device is positioned horizontally, the weight of the vibration excitation source does not affect the force with which the strikers are pressed against the treated surface. However, when the device is positioned in a vertically upward position, which is typically the case when treating ceiling surfaces and joints, the weight of the vibrational excitation source decreases the hold-down force with which the strikers are pressed against the treated surface. In the case of the vertically downward position, the weight of the vibrational excitation source increases the hold-down force with which the strikers are pressed against the treated surface. The small size of the device and the placement of the handle directly on the housing make it difficult for the operator, under vibro-impact conditions, to keep the vibrating tool on the treated surface or the welded joint, thus accelerating the operator's fatigue.

It is also known in the art to use an ultrasound device for improved treatment of surfaces and welded joints (as seen in Ukrainian patent no. 68264), wherein the ultrasound device includes a housing with a metal sleeve installed along the sliding guides with the possibility of reciprocating motion. Inside the sleeve, using vibro-insulators, are installed an ultrasound piezoelectric transducer connected to the vibrational velocity transformer and two sensors—a sensor of the reciprocating motion in the axial direction and a temperature sensor. A pneumatic chamber with a spring is mounted in the housing co-axially with the sleeve. The sleeve is also equipped with an attachment that allows for rotation and quick removal of the working head, with strikers that are installed such that they are allowed to move freely back and forth and to contact the outer edge of the vibrational velocity transformer. Of the two handles affixed to the housing, one is capable of revolving around the housing axis while the other one is stationary.

Such a device possesses an ineffective cooling system since the heated ultrasonic transducer placed inside the sealed metal sleeve transfers the heat only from a very small area of the exterior surface by atmospheric air convection. The heated up working head with strikers has no forced cooling and cools off by ineffective atmospheric air convection only. Dust, dirt, and metal shavings covering the treated work surface interfere with visual control of the treated area during the vibro-impact treatment process, and also tend to get into small gaps between the moveable strikers and the working head, thus jamming the strikers, and stalling the vibro-impact mode operation of the device. Similar to the previously mentioned device, a drawback of this device is inconsistent quality of treatment of surfaces and welded joints. The reason behind such inconsistency is that, depending on the device's spatial positioning, the hold-down force between the vibrational velocity transformer and the strikers varies. This is due to fluctuations in the direction of the gravitational effect of the vibration excitation source upon the spring as the operator presses the strikers to the treated surface through the handle, housing, spring, sleeve with an ultrasound piezoelectric transducer, and the vibrational excitation source. The small size of the device and the placement of the handle directly on the housing make it difficult for the operator, under vibro-impact conditions, to keep the vibrating tool on the treated surface or the welded joint thus accelerating the operator's fatigue.

Ukrainian patent no. 87006, discloses a mechanism for an ultrasound device for improved treatment of surfaces and welded joints which possesses a reliable air cooling system. Discharge of the air through the openings in the working head with strikers towards the treated surface removes dirt and dust off the surface and prevents jamming the strikers in the working head due to clogging.

Nevertheless, this mechanism has significant drawbacks as well. As in the above-mentioned cases, the drawback of such a device is the inconsistent quality of treatment of surfaces and welded joints. The reason behind such inconsistency is that, depending on the device's spatial positioning, the hold-down force between the vibrational velocity transformer and the strikers varies due to fluctuations in the direction of the gravitational effect of the vibration excitation source upon the spring, as the operator presses the strikers to the treated surface through the handle, housing, spring, sleeve with the ultrasonic piezoelectric transducer, and the vibrational excitation source. In the case when the device is positioned horizontally, gravity of the vibration excitation source does not affect the force with which the strikers are pressed to the treated work surface. In the case of the vertically upward position characteristic for treating ceiling surfaces and joints, the gravity of the vibration excitation source decreases the hold-down force of the strikers. In the case of the vertically downward position, the gravity of the vibrational excitation source increases the hold-down force of the strikers. The operator needs to consider these points when changing the spatial position of the device. This encumbers the operator's job and lowers the quality of the treatment since the operator controls the hold-down force only through the position of the pin in the housing slot.

What is desired, therefore, is and ultrasound device that can overcome the various drawbacks discussed above.

SUMMARY OF THE INVENTION

This invention is directed to an ultrasound device for improved treatment of surfaces and welded joints that will ensure consistent high quality of treatment regardless of the spatial positioning of the device by eliminating the orientation-dependent gravitational effect through elements located inside a sleeve to help control the hold-down force upon the work surface of the strikers.

Another aspect of this invention is to create an ultrasound device for deformation treatment of surfaces and welded joints with enhanced functional capabilities by ensuring anchoring of the working head with strikers in an angular position needed to treat hard-to-reach zones of parts and welded joints and enabling free rotation of the working head with strikers when treating flat surfaces.

Yet another aspect of this invention is to create an ultrasound device for deformation treatment of surfaces and welded joints that would defer the operator's fatigue by enhancing the ergonomic characteristics of the device by means of moving the handle away from the housing of the device in the direction opposite to the working head.

According to a preferred embodiment of the present invention, the ultrasound device for deformation treatment of surfaces and welded joints comprises a housing with a handle and sliding guides, wherein a sleeve with an attachment possessing the ability of reciprocal motion is affixed. Said sleeve contains, over vibro-insulation packing, an ultrasound transducer installed on the nodal plane and connected to the oscillation velocity transformer, a temperature sensor and a sensor of the sleeve position in relation to the housing, a forced air-cooling system for the transducer based on feeding compressed air at the butt end of the sleeve and discharging it in the area of the exit opening of the velocity transformer, said transformer being in contact with the striker tips capable of the reciprocal motion and installed within a working head, the cylindrical end of which is mounted on the attachment with the ability of rotating and quick removal. The movement of the sleeve is limited by means of a pin anchored on the sleeve and positioned in a longitudinal slot on the housing and affixed to the front edge of the slot by a spring located between the shoulder formed on the sleeve and the butt-end surface of the housing, with the ability of the sleeve to shift when the strikers are pressed. A moving spigot equipped with pins inserted into shaped slots made in the housing with the ability of anchoring the axial movement of the spigot in three positions is installed between the spring and the butt-end surface of the housing. Said working head with strikers is anchored, to avert axial movement, by means of a spring ball lock, the ball of which enters either one of the sockets made with a one-plane angular pitch or a circular groove made on the cylindrical end of the working head, while the handle is attached to the housing through an extender and shifted in the direction opposite to the working head.

Consistently high quality of treatment of surfaces and welded joints regardless of the spatial positioning of the device is achieved by way of a moving spigot mounted between the spring and the butt-end surface of said sleeve, said spigot being equipped with pins inserted into shaped slots made in the housing for affixing axial movement of the spigot in three positions. Such design of the device cancels the gravity effect of the sleeve with elements located within upon the hold-down force of the strikers on the work surface.

The functional capabilities of the device are enhanced due to the anchoring of the working head with strikers against its axial movement by means of a spring ball lock, the ball of which enters either one of the sockets made with a one-plane angular pitch or into a circular groove made on the cylindrical end of the working head. Such design of the working head enables both the affixed angular position, which is the most convenient for treating difficult-to-access welded joints, and free rotation for treating flat surfaces.

Enhanced ergonomic characteristics of the device are achieved by means of moving the handle away from the housing of the device in the direction opposite to the working head.

BRIEF DESCRIPTION OF THE DRAWINGS

Reference will now be made to the preferred embodiments of the present invention with reference, by way of example only, to the following drawings in which.

DETAILED DESCRIPTION OF THE PREFERRED EMBODIMENTS

Figure 1:
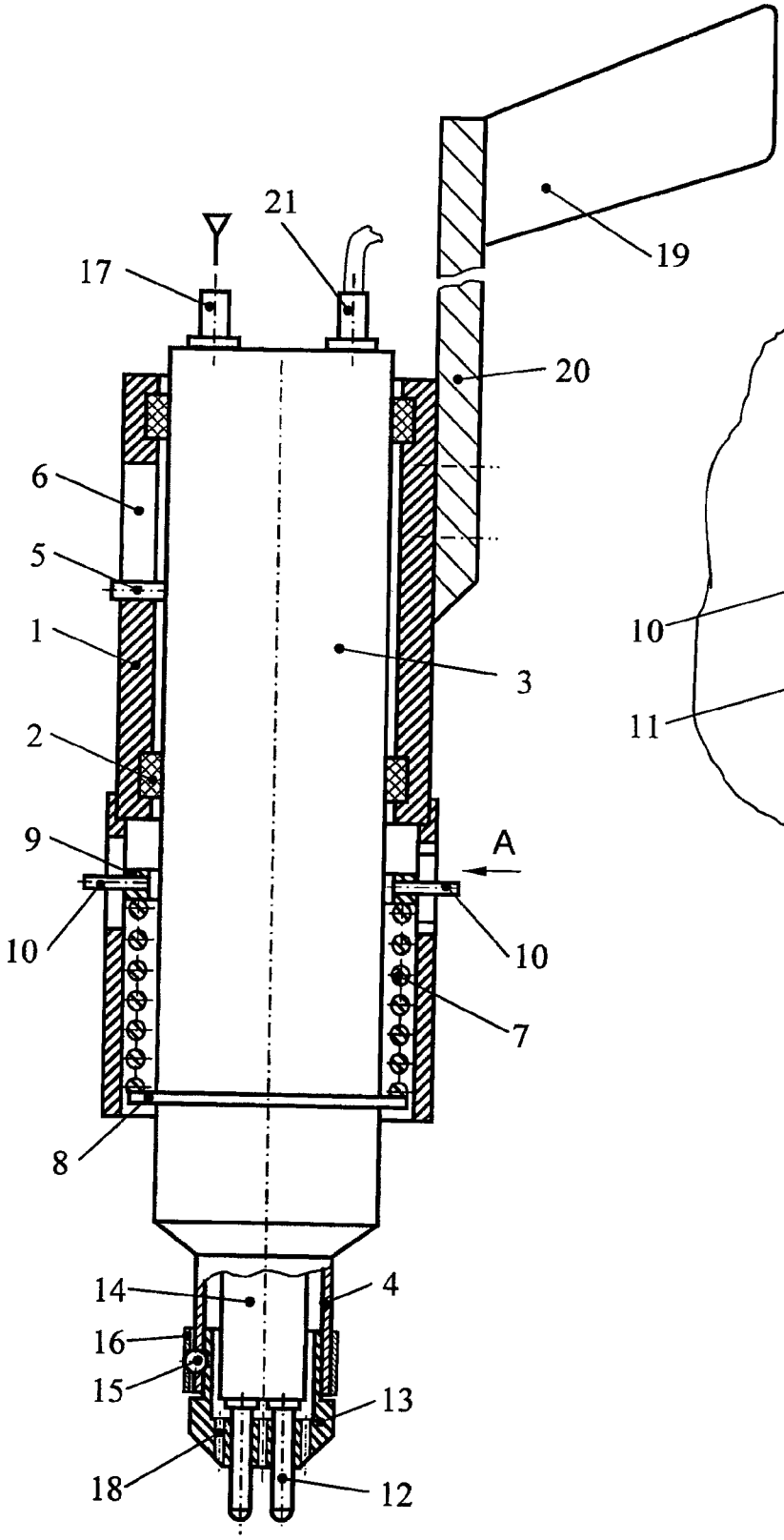
FIG. 1 is a cross-sectional view of the ultrasonic device.
Figure 2:
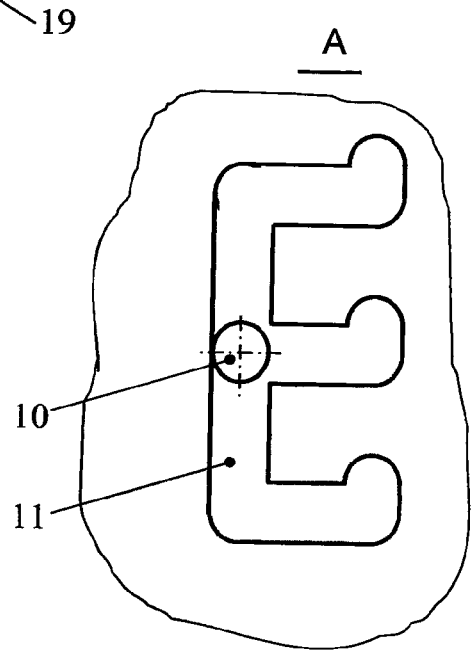
FIG. 2 is a fragmentary view of the pin as it appears when engaging a pin inserted into a shaped slot of the housing (view A).

A preferred embodiment of an ultrasound device for improved treatment of parts and welded joints comprises a housing 1, with sliding guides 2, wherein a sleeve 3 with an attachment 4 possessing the ability of reciprocal motion is affixed. Inside the sleeve 3 is attached, over vibro-insulation packing, an ultrasonic transducer connected to an oscillation velocity transformer through a nodal plane, a temperature sensor and a position sensor capable of sensing the position of the sleeve 3 in relation to the housing 1 (sensors and the ultrasound transducer are not shown in the drawings for convenience). The movement of the sleeve 3 is limited by means of a pin 5 anchored on the sleeve, positioned in a longitudinal slot 6 on the housing 1 and affixed to the front edge of the slot 6 by a spring 7. The spring 7 is located between a shoulder 8 formed on the sleeve 3 and a shifting spigot 9. The shifting spigot 9 is equipped with spigot pins 10 inserted into shaped slots 11 made in the housing 1 with the ability of anchoring the axial movement of the spigot 9 in three positions. The working head 13 possesses the ability to shift when strikers 12 located in the working head 13 are pressed onto a surface and, as a result of reciprocal motion, their tips come into contact with the exit end of the oscillation velocity transformer 14. The cylindrical end of the working head 13 is placed in the attachment 4, which enables rotation and quick removal. The working head 13 is anchored in relation to the attachment 4 by means of a ball 15, a flat cylindrical spring 16, and either sockets made with a one-plane angular pitch or a circular groove made on the cylindrical end of the working head 13. A connector 17 used for compressed air feed to a forced-air cooling system is located in the butt end of the sleeve 3. Air can be discharged through openings 18 in the working head 13, and directed towards the work area. A handle 19 used by an operator to hold the device is attached to the housing 1 through an extender 20 that shifts it in the direction opposite to the working head 13. An electrical cable connecting the ultrasound transducer to the electric oscillation generator (not shown in the drawing for convenience) enters the sleeve 3 over an airtight gasket 21.

The ultrasonic device operates as following: compressed air fed through the connector 17 passes through the sleeve 3, cools off the ultrasonic piezoelectric transducer and leaves the device through the opening 18 in the working head 13 while cooling off the output end of the oscillation velocity transformer 14 and the strikers 12. The temperature sensor controls the temperature of the working transducer preventing its overheating. The strikers 12 are placed into a mechanical contact with the surface of the peened metal. By pressing through the handle 19 and extender 20, the operator attains axial shift of the housing 1 in relation to the sleeve 3 (of 3 to 5 mm) until the sensor of the sleeve 3 position in relation to the housing 1, which is located in the sleeve 3, has been triggered. The shift sensor triggers the ultrasound electric oscillation generator. The ultrasound electric oscillation generator feeds ultrasound frequency voltage through the airtight gasket 21 to the ultrasound transducer, generating in it resonant elastic longitudinal mechanical vibrations. The oscillation velocity transformer 14 increases the amplitude of oscillations of the output end up to 20 to 30 microns. The strikers 12, being in contact with the output end, due to impact interaction, also commence longitudinal vibrations when traveling in the apertures of the working head 13. Kinetic energy acquired by the strikers 12 from the ultrasound transducer is consumed to deform the treated surface and for elastic rebound of the strikers. The hold-down force of the device upon the work surface is 40 to 60 N, the spring 7 is deformed as a result, and the pin 5 in the groove 6 shifts a certain distance. Other factors influencing the magnitude of the hold-down force of the strikers is the gravitational force of the sleeve 3 and the elements it contains. Therefore, depending on the spatial positioning of the device, the operator shifts and anchors the spigot 9 with pins 10 in the shaped slots 11. If the device is positioned horizontally, the operator anchors the pins 10 in the middle notch of the shaped slot 11. If the device is positioned vertically upwards or downwards, the operator shifts and anchors the pins 10 in the respective notches of the shaped slot 11, thus additionally squeezing or loosening the preliminary spring 7 pressure by the amount of the weight of the sleeve 3 and the elements it contains. The device is moved along the welded joint or the work surface. If necessary when treating hard-to-reach joints the operator turns the working head 13 into a necessary discrete position anchoring it by means of the resilient ball 15 that couples with the indents on the cylindrical surface of the cartridge. For vibro-impact treatment of flat surfaces, the operator replaces the working head 13 with in-line positioning of the strikers 12 with a multistriker working head with distributed positioning of the strikers. The cylindrical surface of a working head of this type that gets into contact with the attachment 4 has a groove. The spring-loaded ball 15 fits into this groove, enabling the working head to rotate freely around its axis and preventing it from falling out of the attachment 4. Air discharged through the openings 18 in the working head cleans the work surface, facilitating constant visual control and preventing the debris of the treatment process (e.g. scale, rust, dirt, etc.) from getting into the working head openings, especially the working ones in which the strikers move.

The alternating spring pressure used in the device ensures consistently high quality of treatment of surfaces and welded joints regardless of the spatial positioning of the device. Taking into consideration that the weight of the sleeve with an ultrasound transducer with the power of 400 watt and an oscillation velocity transformer is approximately 20 to 25 N, at the recommended contact pressure onto the strikers of 40-60 N, the significance of introducing the above correction of the preliminary spring pressure is obvious to those skilled in the art. Now, when changing the spatial positioning of the device, there is no need for the operator to correct the applied force and maintain it at a steady level. This will lead to enhanced quality of vibro-impact treatment and facilitate the operator's job. Convenient ergonomic positioning of the handle away from the device will facilitate holding the vibrating device in the operator's hands thus leading to a further increase in the job quality and lessening the operator's fatigue. A working head with strikers able to pivot around its shaft and firmly held in the attachment will further enhance the quality of the vibro-impact treatment of flat surfaces. A working head with in-line striker positioning and discrete angular anchoring expands the device's functional abilities and enhances job quality when treating hard-to-reach welded joints of structures.

The Embodiments of the invention in which an exclusive property or privilege is claimed are defined as follows:

1. An ultrasound device for the treatment of surfaces and welded joints, comprising:

a housing having a front end and a butt end, and having a plurality of shaped slots formed therein, a reciprocally moveable sleeve attached to said housing, said sleeve containing:

i) an ultrasonic transducer, ii) a temperature sensor that senses the temperature of said ultrasonic transducer, iii) a position sensor that senses the position of said sleeve in relation to said housing, and iv) a forced air cooling system for cooling said ultrasonic transducer, a reciprocally moveable attachment attached to an operating end of said sleeve, said attachment having a mounting mechanism that allows mounting of a detachable working head thereon, said working head having striker tips for treating surfaces and welded joints, an oscillation velocity transformer that is connected at one end to said ultrasonic transducer, and is in contact at its other end with said striker tips of said working head, wherein the connection between the oscillation velocity transformer and the ultrasonic transducer is formed at a nodal plane, a pin positioned in a pin slot on said housing, said pin slot having a front edge that corresponds to said front end of said housing, and a back edge that corresponds to said butt end of said housing, said pin anchoring said sleeve to said housing and limiting the movement of said sleeve, said pin being biased towards the front edge of said slot by a spring located between the operational end of said sleeve and the butt end of said housing, and a moveable spigot that provides a predetermined contact force between the ultrasound device and a work surface, said spigot having spigot pins, wherein said spigot pins are inserted into said plurality of shaped slots in order to restrict the axial movement of said spigot, thereby providing added compression or tension to said spring in order to provide said predetermined contact force.

2. The ultrasound device of claim 1, wherein said ultrasonic transducer is installed over vibro-insulation packing.

3. The ultrasound device of claim 1, wherein said plurality of shaped slots consist of one, two, or three shaped slots.

4. The ultrasound device of claim 1, wherein said sleeve is attached to said housing by sliding guides formed in said housing.

5. The ultrasound device of claim 1, further including a handle attached to said housing.

6. The ultrasound device of claim 4, wherein said handle is attached to said housing through an extender.

7. An ultrasound device for the treatment of surfaces and welded joints, comprising:

a housing having a front end and a butt end, and having a plurality of shaped slots formed therein, a reciprocally moveable sleeve attached to said housing, said sleeve containing:

i) an ultrasonic transducer, ii) a temperature sensor that senses the temperature of said ultrasonic transducer, iii) a position sensor that senses the position of said sleeve in relation to said housing, and iv) a forced air cooling system that cools said ultrasonic transducer, a reciprocally moveable attachment attached to an operating end of said sleeve, said attachment having a mounting mechanism that allows mounting of a detachable working head thereon, said working head having striker tips for treating surfaces and welded joints, said mounting mechanism of said attachment including a spring ball locking mechanism capable of engagement with a receiving mechanism located on said working head in order to prevent axial movement of the working head and striker tips, an oscillation velocity transformer that is connected at one end to said ultrasonic transducer, and is in contact at its other end with said striker tips of said working head, wherein the connection between the oscillation velocity transformer and the ultrasonic transducer is formed at a nodal plane, a pin positioned in a pin slot on said housing, said pin slot having a front edge that corresponds to said front end of said housing, and a back edge that corresponds to said butt end of said housing, and said pin anchoring said sleeve to said housing and limiting the movement of said sleeve, said pin being biased towards the front edge of said slot by a spring located between the operational end of said sleeve and the butt end of said housing.

8. The ultrasound device of claim 6, wherein said ultrasonic transducer is installed over vibro-insulation packing.

9. The ultrasound device of claim 6, wherein said plurality of shaped slots consist of one, two, or three shaped slots.

10. The ultrasound device of claim 6, wherein said sleeve is attached to said housing by sliding guides formed in said housing.

11. The ultrasound device of claim 6, further including a handle attached to said housing.

12. The ultrasound device of claim 10, wherein said handle is attached to said housing through an extender.

13. An ultrasound device for the treatment of surfaces and welded joints, comprising:

a housing having a front end and a butt end, and having a plurality of shaped slots formed therein, a reciprocally moveable sleeve attached to said housing, said sleeve containing:

i) an ultrasonic transducer, ii) a temperature sensor that senses the temperature of said ultrasonic transducer, iii) a position sensor that senses the position of said sleeve in relation to said housing, and iv) a forced air cooling system that cools said ultrasonic transducer, a reciprocally moveable attachment attached to an operating end of said sleeve, said attachment having a mounting mechanism that allows mounting of a detachable working head thereon, said working head having striker tips for treating surfaces and welded joints, said mounting mechanism of said attachment including a spring ball locking mechanism capable of engagement with a receiving mechanism located on said working head in order to prevent axial movement of the working head and striker tips, an oscillation velocity transformer that is connected at one end to said ultrasonic transducer, and is in contact at its other end with said striker tips of said working head, wherein the connection between the oscillation velocity transformer and the ultrasonic transducer is formed at a nodal plane, a pin positioned in a pin slot on said housing, said pin slot having a front edge that corresponds to said front end of said housing, and a back edge that corresponds to said butt end of said housing, said pin anchoring said sleeve to said housing and limiting the movement of said sleeve, said pin being biased towards the front edge of said slot by a spring located between the operational end of said sleeve and the butt end of said housing, and a moveable spigot for providing a predetermined contact force between the ultrasound device and a work surface, said spigot having spigot pins, wherein said spigot pins are inserted into said plurality of shaped slots in order to restrict the axial movement of said spigot, thereby providing added compression or tension to said spring in order to provide said predetermined contact force.

14. The ultrasound device of claim 12, wherein said ultrasonic transducer is installed over vibro-insulation packing.

15. The ultrasound device of claim 12, wherein said plurality of shaped slots consist of one, two, or three shaped slots.

16. The ultrasound device of claim 12, wherein said sleeve is attached to said housing by sliding guides formed in said housing.

17. The ultrasound device of claim 12, further including a handle attached to said housing.

18. The ultrasound device of claim 16, wherein said handle is attached to said housing through an extender.

* * * * *

UNITED STATES PATENT AND TRADEMARK OFFICE

CERTIFICATE OF CORRECTION

PATENT NO. : 8,747,732 B2
APPLICATION NO. : 13/634302
DATED : June 10, 2014
INVENTOR(S) : Kudryavtsev et al.

It is certified that error appears in the above-identified patent and that said Letters Patent is hereby corrected as shown below:

In the Claims

Please replace claims 6, 8-12, and 14-18 with the following claims:

6. The ultrasound device of claim 5, wherein said handle is attached to said housing through an extender.

8. The ultrasound device of claim 7, wherein said ultrasonic transducer is installed over vibro-insulation packing.

9. The ultrasound device of claim 7, wherein said plurality of shaped slots consist of one, two, or three shaped slots.

10. The ultrasound device of claim 7, wherein said sleeve is attached to said housing by sliding guides formed in said housing.

11. The ultrasound device of claim 7, further including a handle attached to said housing.

12. The ultrasound device of claim 11, wherein said handle is attached to said housing through an extender.

14. The ultrasound device of claim 13, wherein said ultrasonic transducer is installed over vibro-insulation packing.

15. The ultrasound device of claim 13, wherein said plurality of shaped slots consist of one, two, or three shaped slots.

16. The ultrasound device of claim 13, wherein said sleeve is attached to said housing by sliding guides formed in said housing.

17. The ultrasound device of claim 13, further including a handle attached to said housing.

18. The ultrasound device of claim 17, wherein said handle is attached to said housing through an extender.

Signed and Sealed this
Twenty-eighth Day of July, 2015

Michelle K. Lee

Michelle K. Lee
*Director of the United States Patent and Trademark Office*